United States Patent [19]

Holland et al.

[11] Patent Number: 4,687,279

[45] Date of Patent: Aug. 18, 1987

[54] HIGH FREQUENCY COAXIAL CONNECTOR ADAPTOR

[75] Inventors: Brian J. Holland, Woodridge; Mark P. Kotilinek, Lombard, both of Ill.

[73] Assignee: Storm Products Co., Hinsdale, Ill.

[21] Appl. No.: 811,495

[22] Filed: Dec. 20, 1985

[51] Int. Cl.[4] ..... H01R 17/18

[52] U.S. Cl. ..... 439/578; 439/638

[58] Field of Search ..... 339/179, 177, 252 P, 339/154 R, 154 A, 89 C, 90 C, 156

[56] References Cited

U.S. PATENT DOCUMENTS

| | | | |
|---|---|---|---|
| 3,022,482 | 2/1962 | Waterfield et al. | 339/177 R |
| 3,112,977 | 12/1963 | Long et al. . | |
| 3,340,495 | 9/1967 | Weinschel | 339/177 R |
| 3,391,380 | 7/1968 | Robinson et al. | 339/177 R |
| 3,437,982 | 4/1969 | O'Keefe et al. | 339/177 R |
| 3,671,922 | 6/1972 | Zerlin et al. . | |
| 3,693,140 | 9/1972 | Nijman | 339/252 P |
| 3,845,453 | 10/1974 | Hemmer . | |
| 4,035,054 | 7/1977 | Lattanzi . | |
| 4,167,300 | 9/1979 | Fischer et al. . | |
| 4,280,749 | 7/1981 | Hemmer . | |
| 4,333,697 | 6/1982 | Dreyer . | |
| 4,358,174 | 11/1982 | Dreyer . | |
| 4,437,726 | 3/1984 | Lambert | 339/252 P |

OTHER PUBLICATIONS

Microwave Measurements and Techniques, pp. 77–79 and 82, (date unknown, reference on p. 77 to 1971.

EEM 1983, "Connectors, Terminals & Sockets," pp. 2–1324, 2–1418 and 2–1456, Adams Russell Co. Advertisement, (Copyright 1985).

MSN&CT, Aug. 1985, p. 189.

*Primary Examiner*—Gil Weidenfeld

*Assistant Examiner*—David Pirlot

*Attorney, Agent, or Firm*—Welsh & Katz, Ltd.

[57] ABSTRACT

A high frequency coaxial connector adaptor assembly for mating an APC-7 precision connector member to any of a set of coaxial connectors including N type, TNC type, and SMA type connectors. The invention utilizes a first connector body having an APC-7 interface at one end and having an open structure at the other end with an extended center conductor and outer conducting bushing to interface with any one of the set of coaxial connectors which are specially adapted at one end to engage the open structure of the first connector body. This structure permits an integral structure which does not significantly degrade or distort high frequency signals coupled to the coaxial connector while permitting interchangeable coaxial interfaces.

8 Claims, 7 Drawing Figures

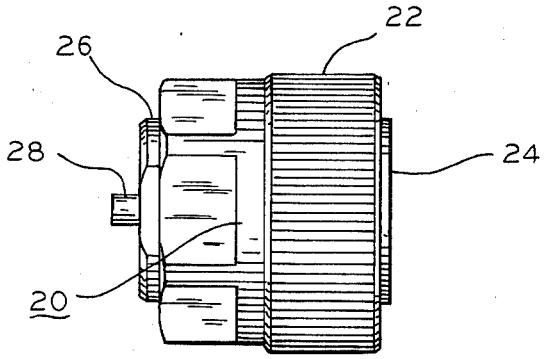
FIG.1
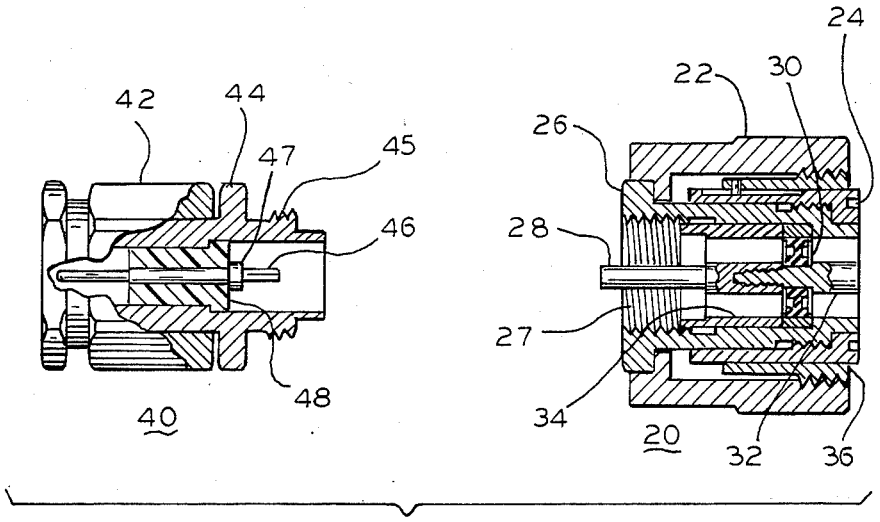
FIG.2
FIG.3
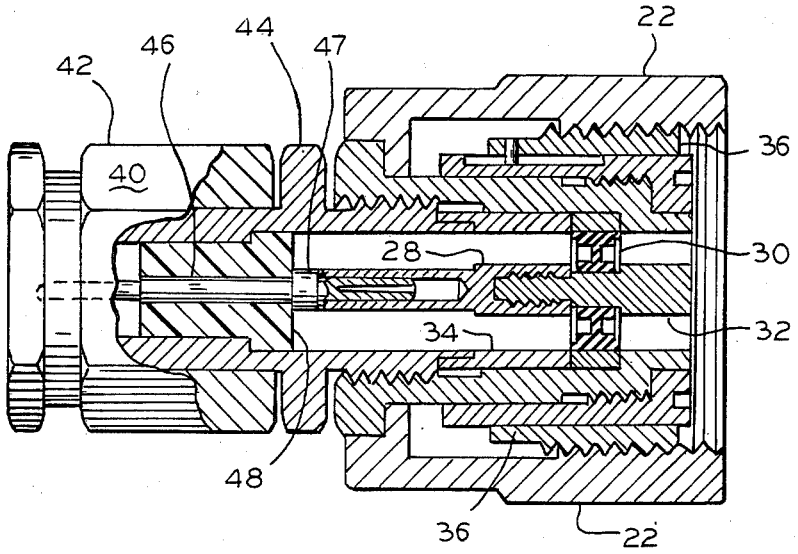

HIGH FREQUENCY COAXIAL CONNECTOR ADAPTOR

This invention relates generally to a coaxial connector adaptor and more particularly to an improved universal coaxial connector adaptor for mating a standard pin and socket contact coaxial connector to a precision coaxial connector having inner and outer butting contacts such as an APC-7 connector.

In recent years, there have been developed a group of industry standard, high frequency coaxial connectors which are extensively utilized at microwave frequencies approaching 20 Ghz. The specific configuration of these coaxial connectors has been embodied in Military Specification C-39012. These specifications include designs for both jack or female configurations and plug or male configurations of numerous connectors, such as those known in the industry as N type, TNC type, and SMA type, as well as APC-7 precision connectors. These coaxial connectors have gained wide acceptance in the industry since they provide excellent high frequency characteristics and can be utilized at frequencies in the range of 18 Ghz.

One shortcoming of these connectors is that each type is incompatible (i.e. cannot mate) with another type. Thus, mismatches of connectors can commonly occur, for example, when immovable equipment having a built-in APC-7 precision connector as a test port must be mated in the field with test devices having another type of connector, such as a TNC connector. Thus, it is necessary to provide some type of interface (i.e. adaptor) between the APC-7 connector and the TNC connector in order to mate the two different types of connectors. As a result of this incompatibility of connector types, a multiplicity of connectors is needed in order to be able to connect various pieces of equipment.

One prior art solution of this problem is to provide a flexible cable having at one end thereof the mating configuration of the APC-7 precision connector and at the other end a configuration of the TNC or other type of connector. This type of interface will bridge the gap between the APC-7 connector member and the TNC connector member of the above example. One of the shortcomings of using the above described connector cables is that the additional length of cable between the connector members tends to degrade the performance of the connector. Even more significant, this type of interface connector cable introduces two additional interfaces by introducing an additional cable coupling interface at both ends of the cable. Since the electrical characteristics of a connector, especially in high frequency application ranges, is substantially affected by each interface, the use of an interface connector cable results in undesirable degradation of electrical performance, such as structural return loss (VSWR, Impedance) and attenuation.

Another type of adaptor utilizes two permanently connected types of connector mating configurations without an intervening cable. However, in order to be able to connect any one of a number of connector types to a single connector type, such as an APC-7 precision connector, either of these above approaches requires an expensive set of adaptors (i.e. one for each connector type desired).

The need for a multiplicity of adaptors is a particularly acute problem with microwave equipment since the connectors can be the source of distortions, reflected signals, etc., at such high frequencies. It is common for equipment used at these frequencies to utilize an APC-7 precision connector for test ports due to its good high frequency characteristics. However, the APC-7 precision connector contains a precision machined mating surface which is susceptable to nicking or scratching which results in distortion of the applied signal. Such nicks and scratches are often produced during connection or disconnection to the test port. Thus, a universal adaptor which can remain on the APC-7 precision connector member of the test port while permitting connection to a variety of coaxial connector types would be highly advantageous.

It is accordingly an object of the invention to provide a novel and improved adaptor assembly for connection to an APC-7 high frequency coaxial connector member to permit direct mating to a plurality of connector types.

It is another object of the invention to provide a novel and improved adaptor for a butting contact precision connector member having interchangeable components to permit mating directly with an SMA type connector, a TNC type connector, or an N type connector.

It is another object of the invention to provide a novel and improved high frequency coaxial connector adaptor assembly which is relatively inexpensive to manufacture and permits interchangeable connector interfaces.

Briefly, according to one embodiment of the invention, a high frequency coaxial connector adaptor is provided comprising a first conductive connector body having a first end adapted to mate to a preselected coaxial connector member and having a conductive annular sleeve forming an outer conductor and a condcutive cylindrical inner conductor concentrically spaced and separated from each other by a dielectric disk, positioned within the conductive connector body and extending to a second end of the conductive connector body. A second conductive connector body is provided which is adapted at one end to removably engage the first conductive connector body at its second end so as to form a secure conductive contact with the conductive annular sleeve and having a concentrically spaced inner conductor separated from the conductive connector body by an insulating member and adapted at one end to removably engage the conductive cylindrical inner conductor to form a secure electrical contact therewith. The second conductive connector body has a second end adapted to mate to a selected type of coaxial connector member.

BRIEF DESCRIPTION OF THE DRAWINGS

The invention, together with further objects and advantages thereof, may be understood by reference to the following description taken in conjunction with the accompanying drawings.

FIG. 1 is a pictorial illustration of a specific embodiment of an APC-7 interchangeable adaptor connector body according to the invention.

FIG. 2 is a cross-sectional side view of a specific embodiment of a separated adaptor assembly according to the invention.

FIG. 3 is a detailed cross-sectional side view of a specific embodiment of an assembled adaptor having an interchangeable TNC plug connector interface according to the invention.

DETAILED DESCRIPTION OF THE PREFERRED EMBODIMENT

Figure 4:
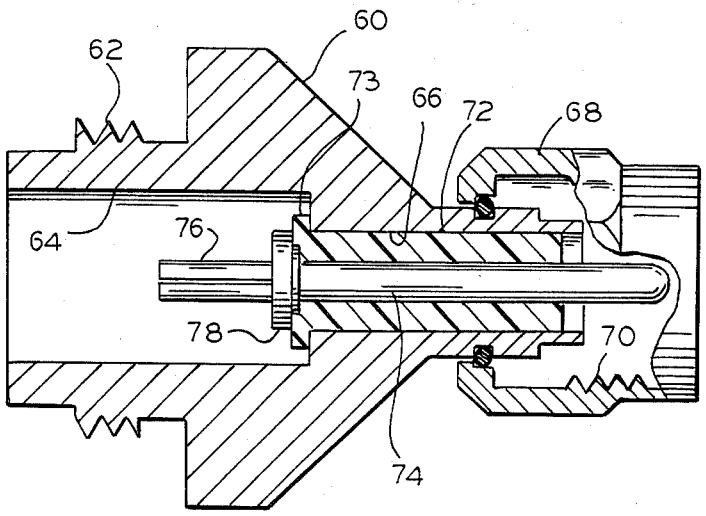
FIG. 4 is a detailed cross-sectional side view of a specific embodiment of an interchangeable SMA plug connector interface according to the invention.

FIG. 1 shows an illustration of a specific embodiment of an APC-7 interchangeable adaptor 20 having an interface to a standard APC-7 precision connector, according to the invention. An outer conductor contact element 24 is provided for forming a precision butting contact with a corresponding APC-7 precision connector (not shown). The contact element 24 is mounted in an outer conductive connector body 22, as shown (composed of stainless steel in the illustrated embodiment), having a conductive element 26 which extends axially through the conductor body 22 to the forward surface of the outer conductor contact element 24, as can be seen in FIG. 2.

The APC-7 interchangeable adaptor 20 has an open structure at the end opposite the butting contact 24 with the conductive element 26 and a center conductor 28 configured to engage any one of a plurality of selected interchangeable coaxial connector interfaces (including SMA, TNC and N type connector interfaces described hereinafter). This structure permits the APC-7 adaptor 20 to connect a variety of coaxial connectors to a corresponding APC-7 port without removing it from its corresponding APC-7 connector member and without requiring the expense of having a separate adaptor for each type of coaxial connector type. Since the APC-7 adaptor 20 can remain in place once installed on a test port, the risk of scratching or nicking its precision surface is greatly reduced.

Referring now to FIG. 2 there is illustrated a cross-sectional side view of the APC-7 interchangeable adaptor member 20 together with a separated interchangeable TNC plug connector interface 40. As shown, the conductive element 26 (e.g. comprised of gold plated brass in the illustrated embodiment) positioned within the conductive connector body 22 is an annular sleeve which is threadedly adapted with internal threads 27 at one end to receive corresponding external threads 45 of an outer conductor element 44 of the interchangeable coaxial connector interface body 42 (e.g. comprised of stainless steel in the illustated embodiment).

The conductive element 26 extends longitudinally, thru the adaptor 20 to the APC-7 contact face 24, as shown. A dielectric disc 30 (e.g. composed of Polyphenylene Oxide in the illustrated embodiment), having on annular outer conductive contact 33 at its circumference, is slidably positioned with the outer contact 33 in conductive contact with the inner surface and an annular internal shoulder of conductive element 26. The dielectric disc 30 includes a central opening 35 into which is positioned a cylindrical conductive center contact 32 (e.g. comprised of gold plated beryllium copper in the illustrated embodiment) having external threads 37 at one end and having an annular radial shoulder 31 intermediate its ends. At the end opposite the threaded end the center contact 32 comprises a central axial recess adapted to receive a set of circumferentially arranged spring loaded fingers (in accordance with Mil. Spec. C-39012) which aid in making complete conductive contact with the center conductor of a corresponding standard APC-7 connector. The conductive center contact 32 is axially positioned in the central opening 35 such that the annular shoulder 31 abuts the disc with the external threads extending beyond the opening 35, as shown in FIGS. 2 and 3. An annular conductive sleeve or bushing 34 (e.g. composed of gold plated brass in the illustrated embodiment) is positioned within the conductive element 26 in conductive contact with the outer conductive contact 33 of the dielectric disc 30, and includes an internal radial shoulder 39, as shown. A cylindrical conductor 28, is positioned axially within the sleeve 34 and extends beyond the end of the sleeve 34, as shown. This conductor 28 includes a recess at one end having internal threads which conductively engage the external threads 37 such that the conductor 28 is effectively mounted at the center of the dielectric disc 30 and forms a conductive extension of the central conductor 32. At the end opposite the threaded end, the conductor 28 has a cylindrical axial recess 41 to receive and conductively engage the central conductor of a selected interchangeable coaxial connector interface to be described hereinafter. Thus, the interchangeable adaptor 20, as herein described and shown, has an open structure at the end opposition the APC-7 interface end, capable of conveniently engaging any one of a plurality of interchangeable coaxial connector interfaces.

FIGS. 2 and 3 illustrate the engagement of the interchangeable coaxial connector interfaces with the adaptor 20, specifically illustrated is a TNC interchangeable coaxial connector inerface 40 separated from (FIG. 2) and coupled with (FIG. 3) the adaptor 20. Referring to FIGS. 2 and 3, the TNC connector interface 40 comprises a conductive connector body 42 (e.g. composed of stainless steel in the preferred embodiment), including a free turning member 44 having external threads 45 adapted to engage the internal threads 27 of the adaptor 20, as shown. The member 44 forms a central bore extending to the TNC interface (as per Mil. Spec. C-39012) with an annular shoulder 43 therein, and functions as the outer conductor of the TNC interchangeable connector interface 40. A cylindrical insulator 48 is axially positioned within the member 44 having an annular shoulder abutting the annular shoulder 43 of the member 44, and includes an axial cylindrical bore 53 adapted to receive a cylindrical center conductor 46, as shown. The center conductor 46 when positioned within the bore 53 is thereby maintained in a fixed concentric spacial relationship with the outer conductor 44. The center conductor 46 includes annular radial shoulder 47 which abuts the insulator 48, and a set of spring loaded tines 49 adapted to conductively engage the recess 41, as shown in FIG. 3. The conductor 46 extends axially through the insulator 48 to the TNC plug interface end of the interchangeable connector interface 40 thereby forming the center conductor for the TNC interface (per Mil. Spec. C-39012).

The structure illustrated in FIGS. 2 and 3 form an integral adaptor for mating an APC-7 and a TNC connector, and illustrate the engagement between the APC-7 adaptor 20 and any one of a plurality of interchangeable connector interfaces including those described hereinafter. In FIG. 3, the annular sleeve 34 provides a contact surface at its internal annular shoulder 39 for conductive engagement of the outer conductor 44 of the connector interface 40. This engagement is secured by the threaded engagement of the threads 27, 45. In addition, the tines 49 of the center conductor 46 are conductively secured within the recess 41 of the center conductor member 28, thereby providing an integral conductive path for the center conductors. This structure forms an enclosed air gap chamber 52, as shown, which together with dimensional characteristics of the inner and outer conductors which are determined by known techniques, establishes the electrical characteristics (such as impedance and VSWR) of the interchangealbe connector adaptor.

Referring now to FIG. 4, there is illustrated a cross-sectional side view of a specific embodiment of an interchangeable SMA plug connector interface 60 according to the invention. This connector interface, as well as all the connector interface embodiments described herein, engage the adaptor 20 in the same manner as the TNC connector interface 40 described hereinbefore to form an integral connector adaptor. As shown, a conductive body element 61 (e.g. composed of stainless steel in the illustrated embodiment) is provided which functions as an outer conductor and forms an inner cylindrical bore 64 at a first end and a smaller diameter bore 66 at the other end. At the first end of the conductive body element 61 are external threads 62 adapted to engage the internal threads 27 of the adaptor 20 as hereinbefore described. At the other end of the conductive body element 61 is mounted a free rotating connector element 68 having internal threads 70 for engaging an SMA connector (as per Mil Spec. C-39012). A cylindrical insulator 72 (e.g. composed of Teflon in the illustrated embodiment) is positioned within the reduced diameter bore 66 with an annular shoulder 73 at one end abutting the edge of the reduced diameter bore, as shown. A center conductor 74 (e.g. composed of gold plated beryllium copper in the illustrated embodiment) is positioned axially through an axial central bore of the insulator 72 thereby providing a center conductor for the connector interface. The center conductor 74 includes a radial shoulder 78 near one end and a set of spring loaded tynes 76 adapted to engage the center conductor 28 of the adaptor 20. Thus the interchangeable SMA plug connector interface 60 provides an SMA plug connector at one end (as per Mil Spec C-39012) and an open structure adapted to securely and integrally engage the adaptor 20 at the other end.

Figure 5:
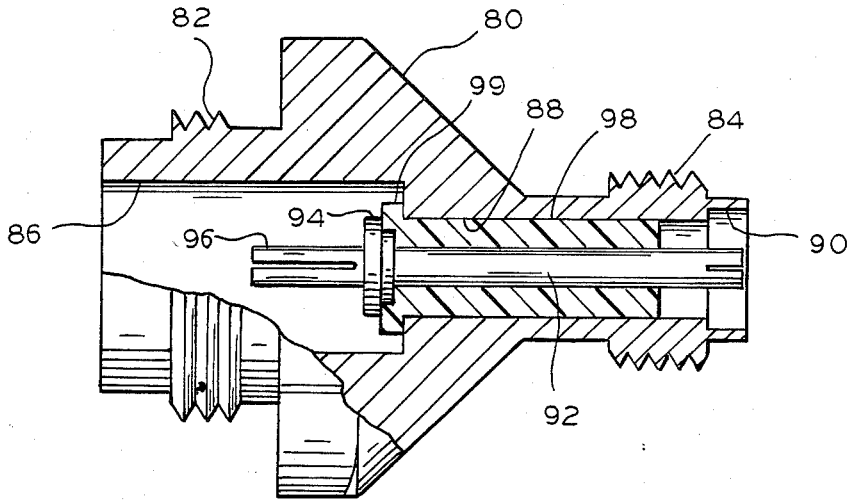
FIG. 5 is a detailed cross-sectional side view of a specific embodiment of an interchangeable SMA jack connector interface according to the invention.

FIG. 5 is an illustration of a cross-sectional side view of a specific embodiment of an interchangeable SMA jack connector interface 80 according to the invention. A conductive outer connector body 81 (e.g. composed of stainless steel in the illustrated embodiment) provides the outer conductor for the interface 80. A cylindrical central bore 86 is provided at a first end and at the other end a smaller diameter cylindrical central bore 88 is provided, thereby forming a two-step central bore. External threads 82 adapted to engage the internal threads 27 of the adaptor 20 are provided at the large bore end and external threads 84, adapted to engage an SMA connector, are provided at the other end of the conductor body 81, as shown. Within the smaller diameter bore a insulating cylinder 98 (e.g. composed of TFE Fluorocarbon in the illustrated embodiment) having an axial central bore 91 and an annular shoulder 99 is positioned such that the annular shoulder abuts the step of the central bore, as shown. A center conductor 92 (e.g. composed of gold plated beryllium copper in the illustrated embodiment) is positioned within the bore 91 having a radial shoulder 94 near one end with a set of spring loaded tynes extending axially therefrom adapted to engage the center conductor 26 of the adaptor 20. At the other end, the center conductor 92 forms a tined end 96 adapted for engagement with a standard SMA plug connector. Thus the interchangeable connector interface 80 provides an SMA jack interface having a center conductor 92, and outer conductor 81 ( as per Mil Spec. C-39012) at one end, and an open structure adapted to form a secure integral connection to the adaptor 20 at the other end.

Figure 6:
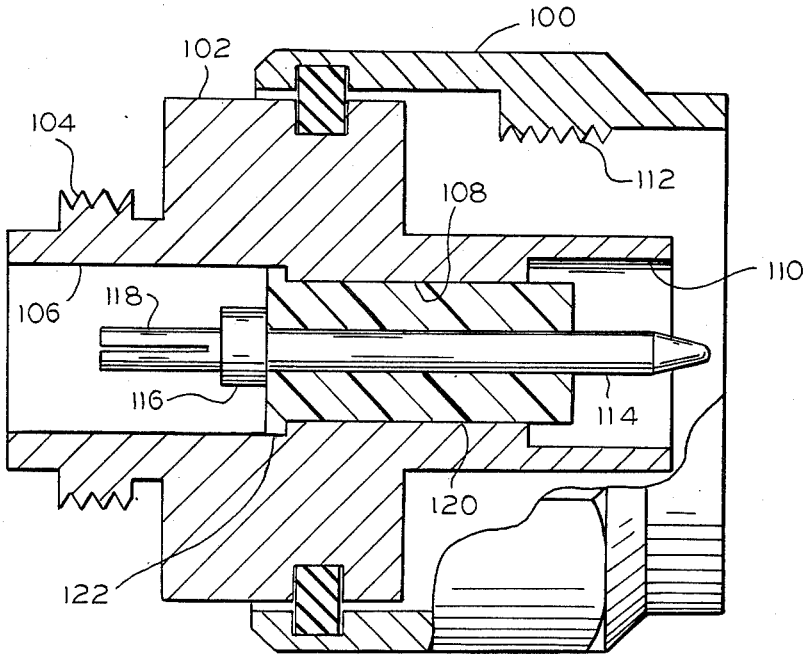
FIG. 6 is a detailed cross-sectional side view of a specific embodiment of an interchangeable N plug connector interface according to the invention.

Referring now to FIG. 6, there is illustrated a cross sectional side view of a specific embodiment of an interchangeable N plug connector interface 100 according to the invention. An outer conductive connector body 102 (e.g. stainless steel in the illustrated embodiment) provides the outer conductor of the connector interface 100 and forms a three step central axial bore composed of a first intermediate diameter bore 106 at a first end, an adjacent smaller diameter bore 108 and a large diameter bore 110 at the other end, as shown. At the first end external threads 104, adapted to engage the internal threads 27 of the adaptor 20, are provided. A free rotating outer connector body element 101 (e.g. composed of stainless steel in the preferred embodiment) is coupled as shown to the conductive body 102 and is provided with internal threads 112 adapted to engage the external threads of a standard N jack connector. A cylindrical insulator 120 (e.g. composed of TFE fluorocarbon in the illustrated embodiment) is positioned, as shown, within the smaller diameter bore with an annular shoulder 122 at one end abutting the edge between the small diameter bore 108 and the bore 106. A center conductor 114 (e.g. composed of gold plated beryllium copper in the illustrated embodiment) is positioned axially through an axial central bore of the insulator 120 thereby providing a coaxial center contact. The center conductor 114 comprises a radial shoulder near one end abutting the insulator 120 with a set of spring loaded tines 118 adapted to engage the center conductor 28 of the adaptor 20. At the second end of the center conductor 114, the center conductor is tapered to provide an N plug interface in accordance with Mil Spec C-39012.

Figure 7:
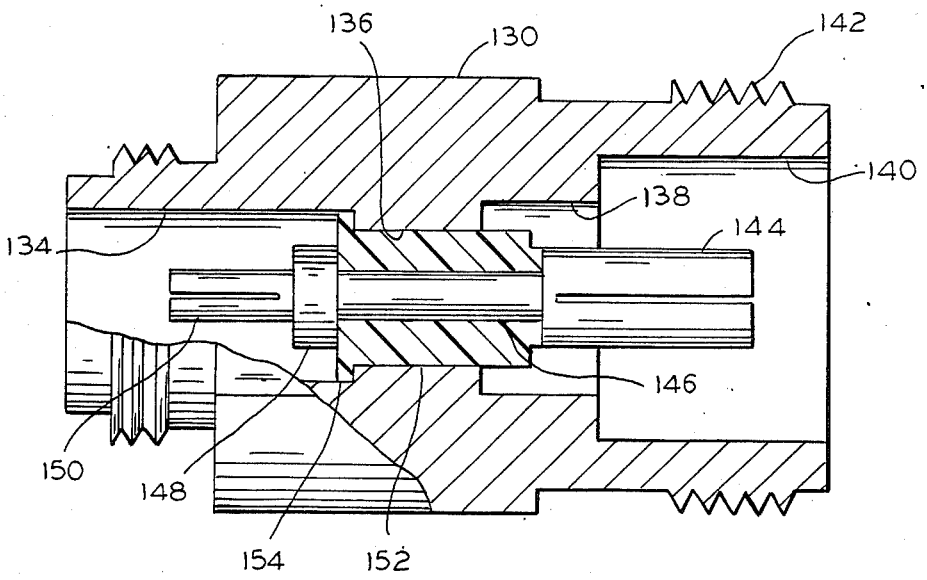
FIG. 7 is a detailed cross-sectional side view of a specific embodiment of an interchangeable N jack connector interface according to the invention.

FIG. 7 is a illustration of a cross-sectional side view of a specific embodiment of an interchangeable N jack connector interface 130 according to the invention. A conductive outer connector body 131 (e.g. composed of stainless steel in the illustrated embodiment) provides the outer conductor for the connector interface 130. A four step cylindrical central bore 134, 136, 138, 140 is provided. At a first end, an intermediate diameter bore 134 is provided suitable for engaging the adaptor 20, as well as external threads 135 which are adapted to engage the internal threads 27 of the adaptor 20. Adjacent bore 134 is a small diameter bore 136 into which is positioned a cylindrical insulator 152 having an annular shoulder 154 abutting the shoulder formed between the bore 134 and the bore 136. The insulator 152 also comprises an annular shoulder 155 at its other end. Two additional steps to the central bore, including a large diameter bore 140 and intermediate diameter bore 138 provide the required configuration for a standard N jack interface (as per Mil Spec. C-39012). External threads 142 are provided to engage internal threads of a standard N plug connector. A central conductor 146

(e.g. composed of gold plated beryllium copper in the illustrated embodiment) is positioned axially through the center of the insulator 152, as shown. At one end, an annular shoulder 148 is provided with a set of spring loaded tynes adapted to engage the center conductor 28 of the adaptor 20. At the other end, the center conductor comprises a set of circumferentially arranged spring fingers adapted to receive the center conductor of a standard N plug coaxial connector.

A specific embodiment of the high frequency interchangeable coaxial connector adaptor has been described for purposes of illustrating the manner in which the invention may be made and used. It should be understood that implementation of other variations and modifications of the invention in its various aspects will be apparent to those skilled in the art, and that the invention is not limited by the specific embodiments described. It is therefore contemplated to cover by the present invention any and all modifications, variations or equivalents that fall within the true spirit and scope of the basic principles disclosed and claimed herein.

What is claimed is:

1. A high frequency coaxial connector adaptor having a first conductive body with a central bore defining an annular shoulder adjacent a first end thereof and terminating in a contact face at the first end adapted to be placed in contact with a mating face of another connector, the adaptor further having an insulating disc having an annular outer conductive contact and an annular inner conductive contact separated by a dielectric, and being slidably positioned within the central bore of the body and adpated to abut the annular shoulder of said body in conductive contact therewith, and the adaptor further having a central cylindrical conductor having external threads at one end, an annular radial shoulder intermediate its ends, and having a central axial recess at its end opposite the threaded end adapted to receive in said recess a plurality of circumferentially arranged spring fingers, the central cylindrical conductor being adapted to be axially positioned within the annular inner conductive contact of the insulating disc with the annular radial shoulder of the central conductor abutting the disc, the adaptor further comprising:

an annular conductive sleeve adapted to be positioned within the central bore of the tubular conductive body of the adaptor in conductive contact therewith, said sleeve having an internal annular radial shoulder at one end and being adapted at the other end to abut the annular outer conductive contact of said insulating disc;

a cylindrical conductive member having recesses at least at its ends and coaxially positionable at least partially within said sleeve, said member having internal threads at one end portion adapted to threadingly and conductively engage the external threads of the said one end of the central conductor of the adaptor, and the opposite end of the said member being adapted to receive a selected one of a plurality of coaxial connector interfaces having an inner conductor with spring fingers adapted to engage the cylindrical conductive member, whereby said annular conductive sleeve provides a contact surface at the internal annular shoulder end for conductively engaging an outer contact of the selected coaxial connector interface to provide a conductive path through the first conductive body, and said cylindrical conductive member provides an integral conductive path with the central cylindrical conductor and the inner conductor for transferring a high frequency signal substantially without distortion.

2. The adaptor as defined in claim 1, wherein said annular conductive sleeve of the adaptor longitudinally extends about said annular outer conductive contact of the insulating disc whereby a controlled annular air gap is provided between said sleeve and the annular shoulder of the annular conductive sleeve.

3. The adaptor of claim 1 wherein the selected one of the plurality of coaxial connector interfaces comprises an N plug connector.

4. The adaptor of claim 1 wherein the selected one of the plurality of coaxial connector interfaces comprises an N jack connector.

5. The adaptor of claim 1 wherein the selected one of the plurality of coaxial connector interfaces comprises a SMA plug connector.

6. The adaptor of claim 1 wherein the selected one of the plurality of coaxial connector interfaces comprises a SMA jack connector.

7. The adaptor of claim 1 wherein the selected one of the plurality of coaxial connector interfaces comprises a TMC plug connector.

8. The adaptor of claim 1 wherein the selected one of the plurality of coaxial connector interfaces comprises a TMC jack connector.

* * * * *

UNITED STATES PATENT AND TRADEMARK OFFICE

CERTIFICATE OF CORRECTION

PATENT NO. : 4,687,279

DATED : August 18, 1987

INVENTOR(S) : Brian J. Holland and Mark P. Kotilinek

It is certified that error appears in the above-identified patent and that said Letters Patent is hereby corrected as shown below:

Column 2, line 35, "condcutive" should read --conductive--. Column 3, line 60, "on" should read --an--. Column 4, line 17, after "28", the comma should be deleted, line 30, "opposition" should read --opposite--, line 36, ", specifically" should read --. Specifically--, and line 37, "inerface" should read --interface--. Column 5, line 45, column 6, line 5 and column 7, line 5, each occurrence, "tynes" should read --tines--. Column 5, line 65, "a" should read --an--. Claims 7 and 8, line 3, each occurrence, "TMC" should read --TNC--.

Signed and Sealed this

Ninth Day of February, 1988

*Attest:*

*Attesting Officer*

DONALD J. QUIGG

*Commissioner of Patents and Trademarks*